United States Patent [19]

Torpey

[11] 4,453,659

[45] Jun. 12, 1984

[54] WEB GUIDING APPARATUS

[75] Inventor: William A. Torpey, Rochester, N.Y.

[73] Assignee: Eastman Kodak Company, Rochester, N.Y.

[21] Appl. No.: 392,507

[22] Filed: Jun. 28, 1982

[51] Int. Cl.[3] ..... B65H 25/10; B65H 25/26; B65H 23/02

[52] U.S. Cl. ..... 226/20; 226/21

[58] Field of Search ..... 226/21, 18, 19, 20, 226/22, 23, 196, 197, 199, 198, 3, 194; 242/76

[56] References Cited

U.S. PATENT DOCUMENTS

| | | | |
|---|---|---|---|
| 2,827,809 | 3/1958 | Beam | 226/19 X |
| 3,224,418 | 4/1966 | Henderson | 226/91 X |
| 3,581,963 | 6/1971 | Rule | 226/21 X |
| 3,682,362 | 8/1972 | Ott, Jr. | 226/21 |
| 3,724,732 | 4/1973 | Bonner | 226/21 |
| 3,786,974 | 1/1974 | Kron | 226/91 |
| 4,069,959 | 1/1978 | Bartell et al. | 226/21 |

*Primary Examiner*—Stuart S. Levy
*Assistant Examiner*—Scott J. Haugland
*Attorney, Agent, or Firm*—Steve W. Gremban

[57] ABSTRACT

A tilt-frame web guiding apparatus for correcting the deviation of a moving web from a true path of the web, in which an edge of the web is parallel to and a predetermined distance from a reference line. An edge sensor senses the edge of the web on an axially movable web exit guide roller, and in response thereto actuates a motor or cylinder for axially moving the web exit guide roller in a direction to maintain the web edge under the sensor. The web exit guide roller is coupled to a pivotally mounted web entry guide roller such that axial movement of the exit guide roller imparts pivotal movement to the entry guide roller for correcting any deviation of the moving web from its true path.

9 Claims, 8 Drawing Figures

WEB GUIDING APPARATUS

BACKGROUND OF THE INVENTION

1. Field of the Invention

This invention is directed to apparatus for guiding traveling webs of material, and more particularly to a tilt frame web guiding apparatus.

2. Description of the Prior Art

It is known in the handling of long webs of material such as film, paper or fabric, in which the web is drawn over rollers from one position to another, that there is a tendency for the web to be laterally displaced from the true or preselected path of the web. Thus, where some operation is to be performed on the traveling web, e.g., the application of a coating or the printing of a design, such operations may not be uniformly applied to the web. Furthermore, the winding of the web on a roll will not be uniform if the traveling web is permitted to become randomly displaced from the centerline of the machine.

Many methods of guiding traveling webs have been utilized employing tilting frames carrying one or more guide rollers over which the traveling web passes. The principle involved in all of these web guiding machines is that the traveling web will attempt to pass across a cylindrical roller, over which it is passing, at right angles to the axis of the roller. Some machines have been constructed wherein a tilting guide frame carrying at least one cylindrical roller is moved so as to direct the traveling web back to the true path of travel, i.e., to the center of the machine. The tilting frame has been driven by various electromechanical, pneumatic, hydraulic or similar drive systems. Likewise, many web guiding machines have been constructed which utilize the tension in the web itself to move the frame and thus are generally self-actuating.

A common feature of most tilt frame web guiding machines of the prior art has been the location of the frame pivot axis near or upstream of the plane of the web entering the machine guide frame. When the web is traveling along its true path, all of the machine rollers are parallel to one another and perpendicular to the longitudinal center line of the web and machine. Also, an edge of the web or a stripe on the web parallel to the web edge is parallel to and a predetermined distance from a reference line.

All of these prior art web guiding machines have found suitable and satisfactory application in various situations. However, some of these web guiding machines have presented long standing problems in web guiding. For example, tilting of the guide frame to reposition a laterally displaced web along its true path generates a skew angle between the web exit guide roller and the succeeding machine roller which is aligned perpendicular to the machine centerline. The rotational twist of the web span exiting the guide frame causes the web to engage the next succeeding roller at a position laterally displaced from its true path or position at which it leaves the exit guide roller, resulting in a small but significant guiding error.

Another long standing problem with the conventional tilt frame-type web guiding apparatus is that the distance between the skewed web exit guide roller and a sensor sensing the web leaving the guide roller changes as the guide frame tilts. This distance change make it difficult to keep a reflective type sensor in focus on the web edge, and it can also cause the web to rub on a transmittance type sensor.

Still another problem with web edge sensing is that the web edge, due to the film twist, may curl and not lay sufficiently flat at the tangent sensing position on the web exit guide roller.

Some of the aforementioned problems of prior art guiding apparatus relating to the web and sensor geometry can be reduced by installing a transmittance sensor along the web span extending between the web exit guide roller and the guide frame and the first roller downstream of the guide frame, that is in the direction of travel of the web. The sensor generally is located at a position ranging from 50 percent to 75 percent downstream of the web span exiting from the web exit guide roller. Location of the sensor along the web span results in a decrease in control loop gain, and introduces a control system phase lag.

SUMMARY OF THE INVENTION

In accordance with a preferred embodiment of the invention, a web guiding apparatus is provided for correcting the deviation of a moving web from a true path of the web. When traveling along its true path, an edge of the web or a stripe on the web parallel to the web edge is parallel to and a predetermined distance from a reference line parallel to the centerline of the machine.

The improved web guiding apparatus comprises a pivotally movable web entry guide roller and a laterally movable web exit guide roller. An edge sensor senses an edge of the web on the web exit guide roller and in response to the web edge position actuates a motor or cylinder for laterally moving the web exit guide roller in a direction to maintain the web edge under the sensor. The web exit guide roller is coupled to the pivotally mounted web entry guide roller such that lateral movement of the exit guide roller imparts pivotal movement to the entry guide roller for correcting any lateral deviation of the moving web from its true path.

More specifically a web guiding apparatus with an edge sensor for sensing an edge of the web on an axially movable web exit guide roller, and means for coupling the web exit guide roller to a web entry guide roller pivotally mounted on a guider frame is a simple, convenient and highly effective way of solving the aforementioned problems of prior art tilt frame web guiding apparatus.

The present invention further substantially eliminates the web twist guiding error inherent in the web span exiting the guide frame and overcomes the undesirable longitudinal movement of the web at the sensor location without sacrificing gain or introducing phase lag.

The invention and its advantages will become more apparent from the detailed description of the invention presented below.

BRIEF DESCRIPTION OF THE DRAWINGS

The details of this invention will be described in connection with the accompanying drawings, in which.

DETAILED DESCRIPTION OF THE INVENTION

Figure 1:
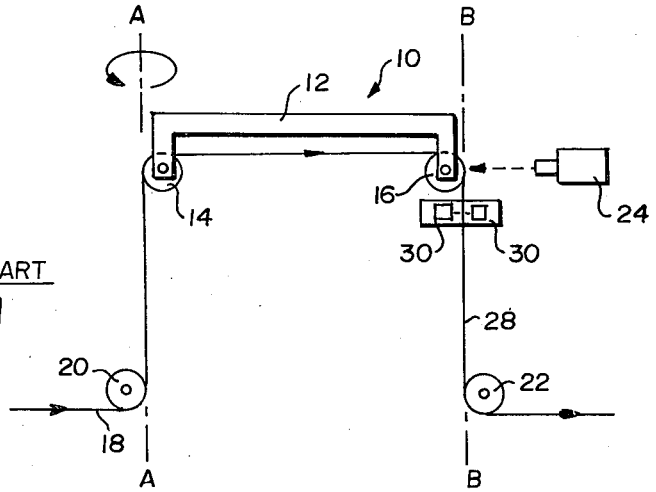
PRIOR ART FIG. 1
FIG. 1 is a schematic, side elevational view of a conventional tilt frame web guiding apparatus.
Figure 2:
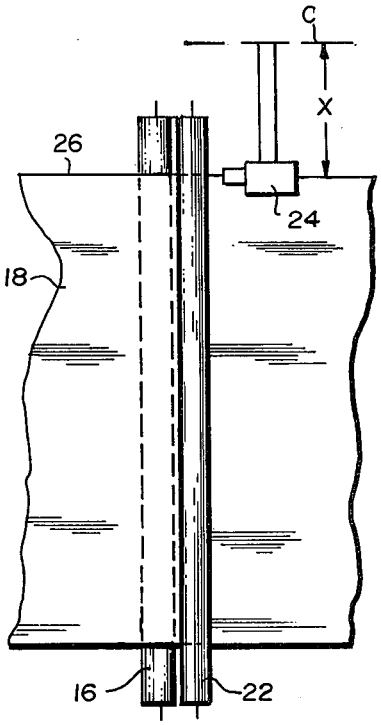
PRIOR ART FIG. 2
FIG. 2 is a top plan view of a part of the web guiding apparatus of FIG. 1.

Referring to FIGS. 1 and 2 of the drawings, a conventional tilt frame web guiding apparatus 10 is disclosed. The conventional web guiding apparatus comprises a generally horizontally oriented rectangular guide frame 12 on which is mounted a pair of web entry and exit frame guide rollers 14, 16 respectively. These rollers ae disposed in parallel, spaced relationship generally transversely of a web 18, and are suitably mounted for rotation on the frame in a manner well known in the art.

The web 18, which may be paper, film, or any other long strip of flexible material, is trained over an entry deflector roller 20, then passes in a generally vertical entry plane A—A to and partially over web entry guide roller 14, then passes to and over web exit guide roller 16, then passes along a vertical plane B—B substantially parallel to entry plane A—A, and then over an exit deflector roller 22. The frame 12 is mounted for pivotal movement in a substantially horizontal plane on a pivot axis lying in the entry plane A—A. A conventional reflective sensor 24 is fixedly mounted for directing a light beam onto one edge 26 of web 18, as best seen in FIG. 2. When the web edge is parallel to and located a fixed distance X from a reference line C parallel to the machine centerline, the web is traveling along a true path.

Figure 3:
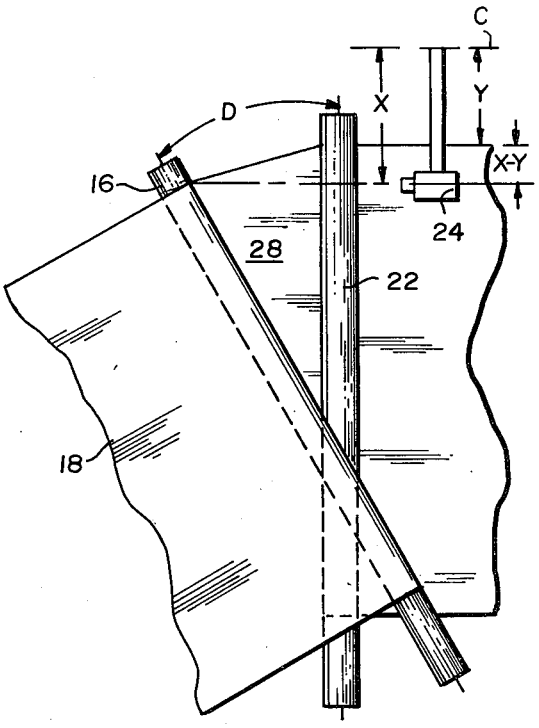
PRIOR ART FIG. 3
FIG. 3 is a top plan view similar to FIG. 2 showing the web twist guiding error inherent in the conventional tilt frame web guiding apparatus.

When the web 18 approaches web guiding apparatus 10 at a lateral position different from fixed distance X, sensor 24 senses this deviation from the true path of the web and actuates driving mechanism, not shown, for automatically pivoting guide frame 12 until web edge 26 is once again aligned with the sensor beam. This pivoting of frame 12 and entry and exit guide rollers 14, 16 respectively generates a skew angle D between exit guide roller 16 and exit deflector roller 22, as best seen in FIG. 3. However, because of the rotational twist in web exit span 28 between rollers 16, 22, the web 18 will engage roller 22 at a lateral position in which web edge 26 is a different distance Y from reference line C. The distance X−Y is a small, but significant web twist guiding error in a conventional tilt frame web guiding apparatus 10.

The guiding error X−Y for the aforementioned conventional web guiding apparatus can be calculated as follows:

Web twist error$=W/2\ (1-\cos D)$ where W is the width of the web.

With reference to FIG. 3, an additional shortcoming to the conventional web guiding apparatus 10 is that as guide frame 12 pivots, the distance between the web exit guide roller 16 and reflective sensor 24 changes. This makes it difficult to keep reflective sensor 24 in focus at web edge 26. Also, the web edge may curl and not lay sufficiently flat on roller 16 at the exiting tangent sensing position. Where a transmittance sensor 30 having a transmitter and receiver is used for sensing an edge of the web, such as shown in FIG. 1, the likelihood exists that the twisting of web span 28 between rollers 16, 22 may cause web 18 to rub on the transmitter or receiver of sensor 30. Location of the sensor along web span 28 will also result in a decrease in control loop gain, and will introduce a control system phase lag.

Figure 6:
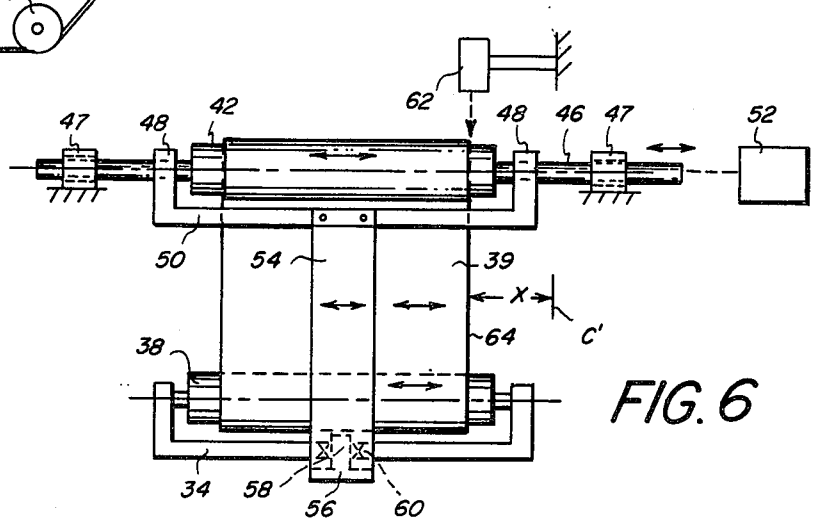
FIG. 6 is a front end elevational view of the web guiding apparatus of FIG. 4.
Figure 5:
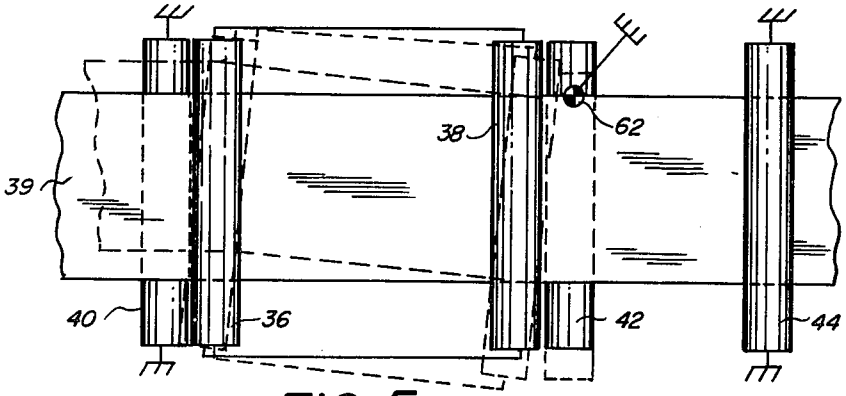
FIG. 5 is a top plan view of the web guiding apparatus of FIG. 4 with portions thereof omitted for purposes of clarity.
Figure 4:
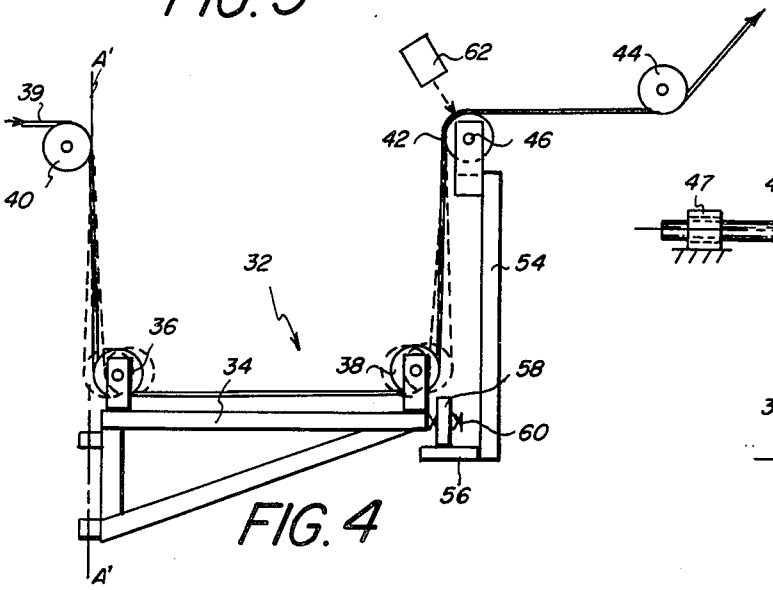
FIG. 4 is a schematic, side elevational view of a tilt frame web guiding apparatus embodying the principles of this invention.

With reference to FIGS. 4–6, a schematic tilt frame web guiding apparatus 32 incorporating the principles of the present invention is disclosed. The novel web guiding apparatus comprises a pivotally mounted guide frame 34 and parallel, spaced apart web entry and web exit guide rollers 36, 38 respectively rotatably mounted on the frame. A web 39 to be guided is trained over entry deflector roller 40, entry guide roller 36, exit guide roller 38 and exit deflector rollers 42, 44 respectively. Exit deflector roller 42 has an axle 46 fixed thereto, as best seen in FIG. 6, which is rotatably in fixed bearings 47 and upstanding arms 48 of a U-shaped frame member 50. Roller 42, axle 46 and frame member 50 are laterally movable in unison upon sliding movement of axle 46 through bearings 47 by any suitable operating cylinder or motor 52. A tie bar 54 has one end secured to frame member 50, and has a laterally extending flange 56 at its other end supporting an upstanding stub shaft 58. Shaft 58 extends through a self aligning bearing 60 mounted on the free end of guide frame 34.

A fixed reflective sensor 62 is focused on a web edge 64 passing over slidable exit deflector roller 42. Accordingly, any deviation of web 39 from its true path is sensed by sensor 62 which activates motor 52 for slidably driving axle 46, roller 42, frame member 50 and tie bar 54 in unison in the proper direction for maintaining sensor 62 focused on web edge 64. The tie bar 54, in turn, imparts pivotal movement to guide frame 34 and guide rollers 36, 38 about pivot axis A′—A′ via the bearing coupling 58, 60. Pivotal movement of the frame and rollers corrects the lateral deviation of web 39 so that it reassumes its true path of travel in which web edge 64 is parallel to and a fixed distance X from a reference line C.

Although web exit guide roller 42 is mechanically coupled to guide frame 34, such coupling could be achieved by any other suitable means, such as a servo control system, for example. Also, frame 34 could rotatably support one or more pivotal web entry guide rollers.

Figure 7:
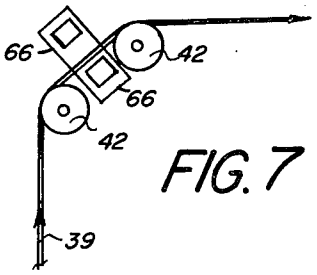
FIG. 7 is a segmental view of an alternate arrangement for the web exit guide roller to accommodate a transmittance type sensor.

With reference to FIG. 7, to adapt the tilt frame web guiding apparatus 32 for use with a transmittance type sensor 66, a pair of axially movable spaced exit deflector rollers 42 are substituted for the single roller 42. This provides a straight web span between rollers 42 with substantially no edge curl for accommodating the transmittance sensor 66. With a pair of rollers 42, other sensing mode options are available, such as a reflective sensor adjacent one or both of the rollers 42 for sensing the web edge on each roller.

Figure 8:
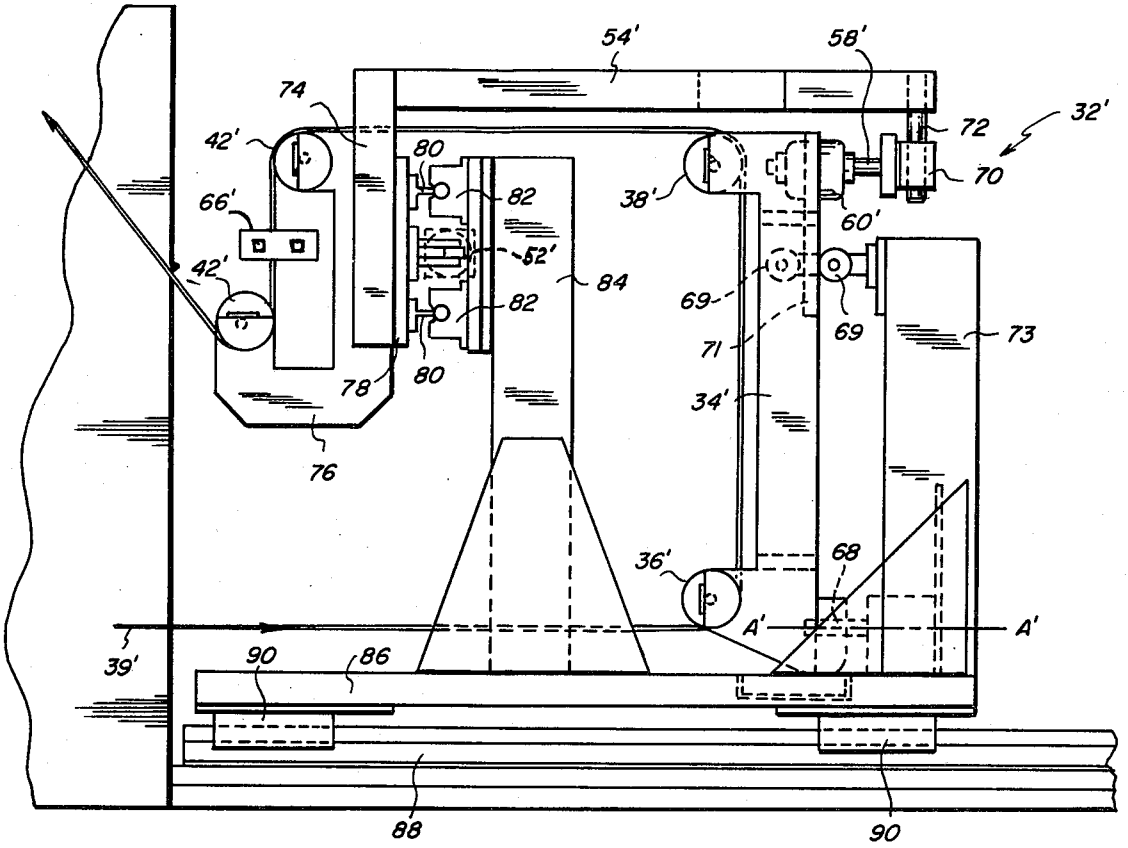
FIG. 8 is a side elevational view of a preferred embodiment of the tilt frame web guiding apparatus of this invention.

With reference to FIG. 8, another embodiment of a tilt frame web guiding apparatus 32′ for guiding a web 39′ to a coating device or the like, not shown, is disclosed. In this figure, parts similar to parts disclosed in FIGS. 4–7 will be denoted by the same numbers primed. Guide frame 34′ is vertically oriented and pivotal at one end about stub shaft 68 on pivot axis A′—A′.

Frame 34′ is retained in its vertical orientation by spaced apart guide members 69 slidably engaging opposite sides of a plate section 71 on frame 34′. Guide members 69 are secured to a fixed post 73.

Frame 34′ has a bearing 60′ at its free end within which a stub shaft 58′ is rotatably journaled. A bushing 70 secured to one end of stub shaft 58′ is slidably and rotatably mounted on a stub shaft 72 vertically depending from one end of a laterally movable tie bar 54′. The opposite end of tie bar 54′ has a vertically depending flange 74 for supporting J-shaped plate 76 secured by any suitable means, not shown, to flange 74. The plate 76 rotatably supports a pair of parallel, spaced web exit deflector rollers 42′. A plate 78 supporting parallel, spaced guide rails 80 is secured to one side of tie bar flange 74. Guide rails 80 are slidably movable in guide ways 82 secured to a fixed vertical frame member 84. Transmittance sensor 66′, is mounted for sensing the web edge on the web span extending between deflector rollers 42′. The sensor is electrically coupled to motor 52′ and actuates the motor when the web 39′ deviates from its true path. Motor 52′ is coupled to frame 76 for laterally moving it in the proper direction for maintaining the sensor focused on the web edge. Movement of frame 76 and tie bar 54′ carried thereby imparts pivotal movement to guide frame 34′ and guide rollers 36′, 38′ about pivot axis A′—A′ for returning web 39′ to its true path of travel.

Frame member 84 is mounted on a horizontal support plate 86 which is slidably movable on a pair of rails 88 via bushings 90 secured to and depending from plate 86 and encircling parts of rails 88. By virtue of rails 88 and bushings 90, the tilt frame web guiding apparatus 32′ is movable to and from its normal web guiding position.

While preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. Web guiding apparatus for correcting the deviation of a moving web from a true path of the web in which an edge of the web is parallel to and a predetermined distance from a reference line, said apparatus comprising:

an entry guide roller over which the web is trained;

means for supporting said entry guide roller for pivotal movement about a pivot axis transverse to the axis of said entry guide roller;

an axially movable exit guide roller over which the web is trained, said exit guide roller having a fixed unmovable axis substantially parallel to the axis of said entry guide roller when the web is traveling along its true path;

means coupling said entry and exit guide rollers wherein axial movement of said exit roller along said fixed axis imparts pivotal movement to said entry roller;

means for axially moving said exit guide roller; and means for sensing an edge of the web adjacent said exit guide roller and actuating said exit guide roller moving means to position said exit and entry guide rollers so that the web is guided along said true path.

2. Web guiding apparatus according to claim 1 wherein said means for coupling said entry and exit guide rollers comprises a first frame for rotatably supporting said entry guide roller, said first frame being pivotally mounted at one end thereof about said pivot axis, a second frame for slidably supporting said exit guide roller, and bearing means coupling said first and second frames together.

3. Web guiding apparatus according to claim 2 wherein said bearing means comprises a first bearing on one of said first and second frames, a first stub shaft having one end rotatably supported by said first bearing, a second bearing mounted on the other end of said first stub shaft, and a second stub shaft having one end mounted on the other of said first and second frames and the other end of said second stub shaft slidably supported by said second bearing.

4. Web guiding apparatus according to claims 1, 2 or 3 wherein said pivot axis of said entry guide roller is in the plane of and directionally aligned with the web entering said guiding apparatus.

5. Web guiding apparatus for correcting the deviation of a moving web from a true path of the web in which an edge of the web is parallel to and a predetermined distance from a reference line, said apparatus comprising:

a first movable guide frame lying in a first plane;

first and second rollers rotatably mounted on said first guide frame in parallel spaced relation;

a second frame separate from said first frame lying in and laterally movable within a plane transverse to said first plane;

a third roller rotatably mounted on and laterally movable with said second frame;

means coupling said first and second frames wherein lateral movement of said third roller and second frame imparts pivotal movement to said first frame;

means for laterally moving said third roller; and means for sensing an edge of the web adjacent said third roller and actuating said third roller moving means to position said first, second and third rollers so that the web is guided along said true path.

6. Web guiding apparatus according to claim 5 wherein said first guide frame is pivotally movable about a pivot axis transverse to said first plane, and said third roller is axially movable.

7. Web guiding apparatus according to claim 6 wherein said means coupling said first and second frames comprises bearing means.

8. Web guiding apparatus according to claim 7 wherein said bearing means comprises a first bearing on one of said first and second frames, a first stub shaft having one end rotatably supported by said first bearing, a second bearing mounted on the other end of said first stub shaft, and a second stub shaft having one end mounted on the other of said first and second frames and the other end of said second stub shaft slidably supported by said second bearing.

9. Web guiding apparatus according to claims 6, 7 or 8 wherein said pivot axis is in the plane of and directionally aligned with the web entering said guiding apparatus.

* * * * *